United States Patent [19]

Theurer et al.

[11] 4,178,995

[45] Dec. 18, 1979

[54] SELF-PROPELLED BALLAST CLEANING MACHINE FOR ON- AND OFF-TRACK WORK

[75] Inventors: Josef Theurer, Vienna; Karl Fölser, Linz-Urfahr, both of Austria

[73] Assignee: Franz Plasser Bahnbaumaschinen-Industriegesellschaft m.b.H., Vienna, Austria

[21] Appl. No.: 796,841

[22] Filed: May 13, 1977

[30] Foreign Application Priority Data

May 31, 1976 [AT] Austria ..... 3987/76
Sep. 13, 1976 [AT] Austria ..... 6782/76

[51] Int. Cl.[2] ..... E01B 27/06
[52] U.S. Cl. ..... 171/16; 104/2
[58] Field of Search ..... 171/16; 37/104–107; 104/2, 7 R, 7 B, 12

[56] References Cited

U.S. PATENT DOCUMENTS

| | | | |
|---|---|---|---|
| 1,029,894 | 6/1912 | Schellenger | 239/650 |
| 1,029,895 | 6/1912 | Schellanger | 239/650 |
| 1,777,588 | 10/1930 | Tellis | 37/105 |
| 1,907,944 | 5/1933 | Forbes | 37/105 |
| 2,142,208 | 1/1939 | Protzeller | 171/16 |
| 2,624,130 | 1/1953 | Perier | 37/104 |
| 2,734,730 | 2/1956 | Talboys | 171/16 |
| 2,737,901 | 3/1956 | Drovard | 171/16 |
| 2,747,850 | 5/1956 | Judd et al. | 171/16 |
| 2,989,930 | 6/1961 | Flowers | 37/104 |
| 3,491,467 | 1/1970 | Finger | 37/104 |
| 3,803,733 | 4/1974 | Ramsey | 37/104 |
| 3,811,382 | 5/1974 | Buchter et al. | 37/104 |
| 3,850,251 | 11/1974 | Plasser et al. | 171/16 |
| 3,957,000 | 5/1976 | Plasser et al. | 171/16 |
| 4,014,389 | 3/1977 | Theurer et al. | 104/7 A |
| 4,064,807 | 12/1977 | Theurer | 104/7 A |
| 4,108,076 | 8/1978 | Knapie | 104/2 |

*Primary Examiner*—Louis G. Mancene
*Assistant Examiner*—Paul J. Hirsch
*Attorney, Agent, or Firm*—Kurt Kelman

[57] ABSTRACT

A self-propelled ballast cleaning machine useful for work in track switch and other widening track sections comprises selectively operable on- and off-track undercarriages supporting the machine frame for selected on- or off-track operation. A ballast excavation chain adjustable in width for operation in widening track sections delivers excavated ballast to a screen for cleaning the ballast and the excavated ballast is stored immediately adjacent a ballast excavating chain portion when it may be discharged in controlled amounts. A vertically movable plow levels the discharged ballast and includes plowshares adjustable for leveling ballast in widening track sections.

19 Claims, 4 Drawing Figures

SELF-PROPELLED BALLAST CLEANING MACHINE FOR ON- AND OFF-TRACK WORK

The present invention relates to a self-propelled ballast cleaning machine useful for work in track switch and other widening track sections for excavating ballast material from a track bed, distributing the ballast material and returning it to the bed, preferably after being cleaned. Self-propelled ballast cleaning machines comprise a machine frame, a ballast material excavation chain mounted thereon and adjustable in width for operation in widening track sections, the chain having a portion for excavating engagement with the ballast, and a screen arrangement mounted on the machine frame and arranged to receive ballast material excavated by the chain from the chain for cleaning the excavated ballast material.

Many types of self-propelled ballast cleaning machines are known wherein an endless ballast excavation chain is mounted in a triangular chain guide mounted in a plane inclined to the plane of the track, a transversely extending portion of the guide and chain extending below the track in the ballast to excavate the ballast and convey the excavated ballast upwardly away from the track bed and to a screen where the waste or dirt is separated from the ballast, conveyors being provided to remove the waste in desired directions and for conveying and distributing the cleaned ballast back to the bed. These known machines are operable only in plain track sections, i.e. neither in switches nor on trackless sections. One such machine is disclosed in British Pat. No. 1,067,465, published May 3, 1967.

U.S. Pat. No. 3,850,251, dated Nov. 26, 1974, discloses a mobile ballast cleaning machine with an endless ballast excavating chain whose transversely extending ballast excavating portion may be adjusted in width by changing the angle between two chain guide portions supporting this ballast excavating portion. The machine is complex in structure and requires additional chain guides and supports.

A successful excavating mechanism for excavating ballast in widening track sections, such as track switches, branches, crossings and the like, has been disclosed in U.S. Pat. No. 4,014,389, dated Mar. 29, 1977, and U.S. application Ser. No. 641,749, filed Dec. 18, 1975, and now U.S. Pat. No. 4,043,398. These ballast cleaning machines are operable only on-track.

In the track laying train disclosed in U.S. Pat. No. 3,685,456, dated Aug. 22, 1972, ballast cleaning and distributing mechanisms are disclosed which may be selectively operated on- and off-track during the track renewal operation. However, these mechanisms form part of the train and are not self-propelled for independent use. Moreover, they are not adapted for use in track switches and like widening track sections.

Thus, the known ballast cleaning machines can be used only for on-track or for off-track operation without making a selective on- or off-track use possible, or they require relatively complicated auxiliary devices and/or can be used only on plain track sections and not at switches. This holds true also for machines of this type which are used to lay down a sand bed for the ballast.

It is the primary object of this invention to provide a ballast cleaning machine of the first-described type useful for work in track switch and other widening track sections and selectively operable on- or off-track, and which permits rapid and economical work, simple transition between on- and off-track work, and which produces an accurately leveled ballast bed.

The above and other objects and advantages are accomplished in accordance with the invention with a ballast cleaning machine of the indicated structure, which comprises a ballast storage means mounted on the machine frame immediately adjacent the ballast excavating chain portion, the ballast storage means having adjustable ballast discharge port means capable of discharging controlled amounts of ballast from the storage means, means for moving the excavated ballast material to the ballast means, and a ballast plow means vertically movably mounted on the machine frame and arranged to level the ballast discharged from the storage means, the plow means including plowshare means adjustable for leveling ballast in widening track sections.

Such a self-propelled machine may be rapidly moved to and from a working site, the ballast excavating, distributing and leveling means being adjustable without difficulty for all types and widths of track beds. The machine is universally useful in straight track, track switches and trackless sections, operating without interruption as it moves from a straight to a switch section and/or between on- and off-track work. The flexible adjustment of the ballast redistributing and leveling mechanisms makes it possible uniformly to distribute cleaned ballast over varying widths of bed and to level the cleaned ballast after distribution. The continuous cooperation of the ballast excavation over the entire width of the bed with the immediately following redistribution of the cleaned ballast and its leveling provides a more smoother ballast bed for the subsequent laying of the track, thus increasing the accuracy of the track grade. The uninterrupted operation between on- and off-track work considerably increases the efficiency of the machine while assuring uniform production which further enhances the quality of the ballast bed.

The above and other objects, advantages and features of the present invention will become more apparent from the following detailed description of certain now preferred embodiments thereof, taken in conjunction with the accompanying drawing wherein FIG. 1 is a somewhat schematic side elevational view of a mobile ballast cleaning machine in operational position on a ballast bed section with track;

Figure 1:
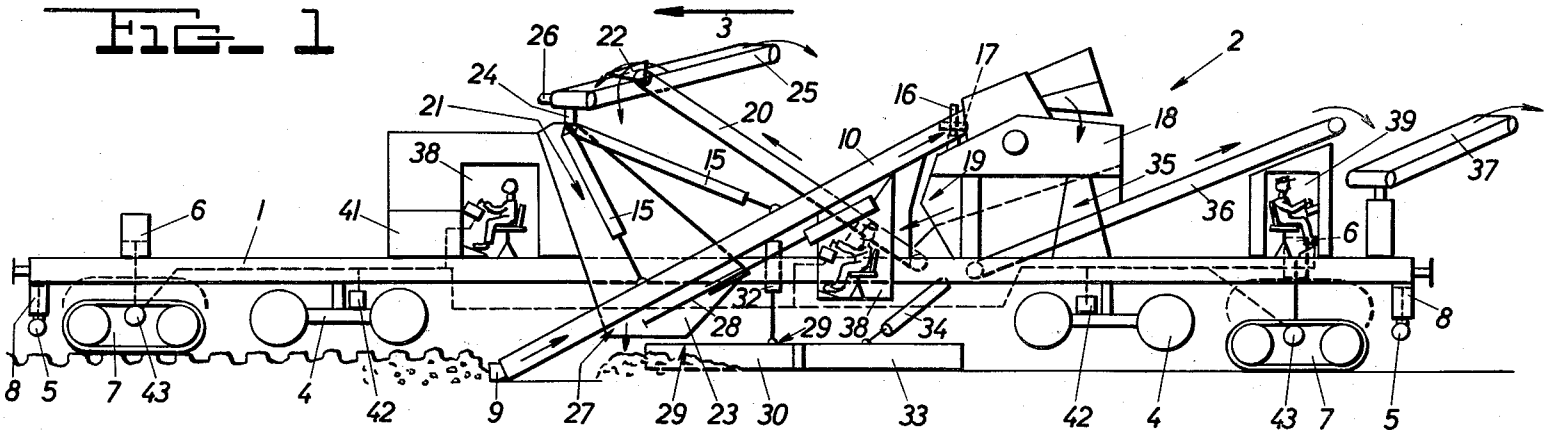
Figure 2:
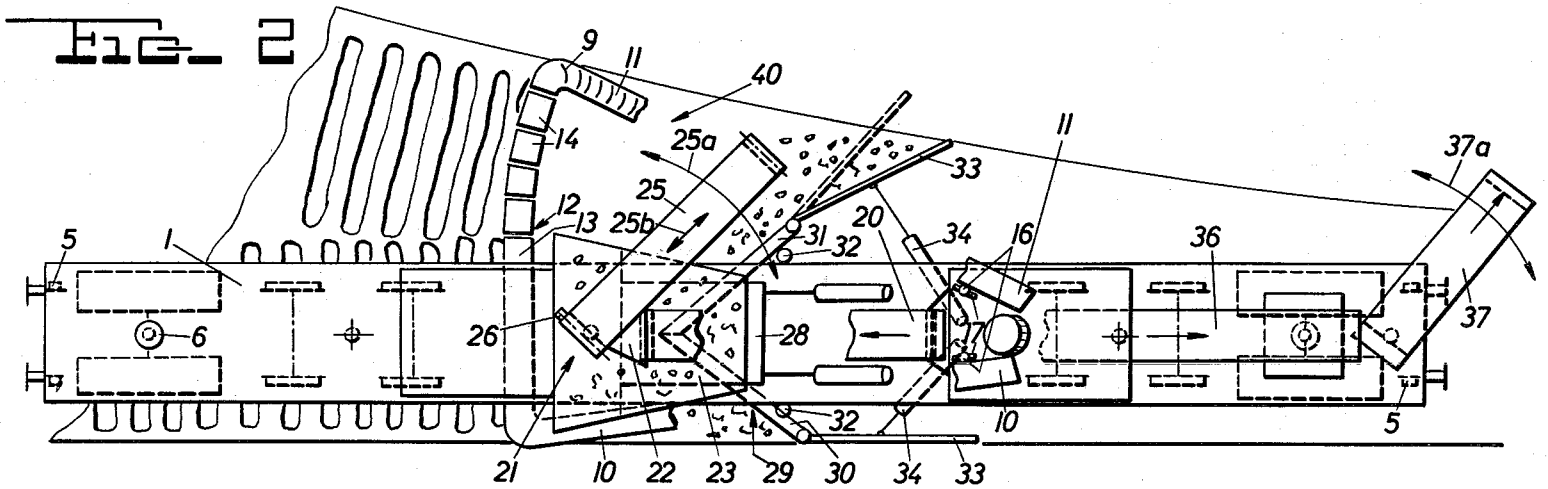
FIG. 2 is a top view of the machine of FIG. 1, partially showing a ballast bed widening in the operating direction, as in the range of a lifted track switch.

Referring now to the drawing and first to FIGS. 1 and 2, there is shown self-propelled track working machine 2 constituted in the illustrated embodiment by a ballast cleaning machine including machine frame 1. The machine is movable in a working direction indicated by arrow 3 and, for this purpose, on-track undercarriages 4, 5 and off-track undercarriages 7 are mounted on frame 1 for selectively moving the machine on a track or on the ballast bed. In the illustrated embodiment, undercarriages 4 are double-axle swivel trucks on which the machine frame is mounted and which have four flanged wheels for engagement with the track rails while undercarriages 5 at either end of the frame comprise a single axle carrying a pair of flanged wheels for engagement with the track rails, the undercarriage axle being movable vertically as well as transversely of the track by hydraulic motor means 8 for selective engagement with a track. Undercarriages 7 are track-laying bogies which are vertically movable by hydraulic motors 6 for selective engagement with the ballast bed. In the full-line position shown in FIG. 1, the tracked bogies have been lowered into contact with the underlying ballast bed while undercarriages 4 and 5 are out of contact with the ground. When undercarriages 7 are lifted by motors 6 into a position shown in broken lines in FIG. 1, swivel trucks 4 will contact track rails laid under it and single-axle undercarriages 5 may also be lowered into track engaging position.

In a generally conventional manner, ballast excavation and conveying chain 9 is mounted on machine frame 1 between the undercarriages, the excavation chain being arranged to remove and convey ballast and sand and/or waste admixed thereto from the bed. The excavation chain moves in a polygonal path determined by chain guides shown to include longitudinally extending guides 10, 11 and transversely extending guide 12. The illustrated ballast excavation mechanism is similar to that disclosed in U.S. Pat. No. 4,014,389, dated Mar. 29, 1977, and U.S. application Ser. No. 641,749, filed Dec. 18, 1975, and now U.S. Pat. No. 4,043,398.

As fully described in the afore-mentioned patents and only schematically shown herein, transverse chain guide 12 is comprised of fixed chain guide portion 13 and a plurality of removable chain guide members 14 which may be assembled and disassembled to adjust the width of the transverse guide for operation at a track switch, for example, as shown in FIG. 2. Longitudinally extending excavation chain guides 10 and 11 are respectively supported on vertical pivot 16 and horizontal pivot 17, and hydraulic motors 15, 15 are connected to guides 10 and 11. Selective operation of motors 15 will pivot the excavation chain about pivot 16 to adjust the chain position in a vertical and/or lateral direction.

Vibratory ballast screen 18 is mounted on machine frame 1 for receiving the removed ballast and waste excavated by the chain from the ballast bed, and the cleaned ballast is discharged from the screen through discharge port 19 which deposits the cleaned ballast at an input end on endless ballast conveyor 20 which conveys the cleaned ballast to its output end whence it may be discharged into storage device 21 mounted below the output end of ballast conveyor 20. A ballast guiding and distributing device 22 is pivoted to the output end of conveyor 20 for selectively discharging the cleaned ballast to storage bin 23 of storage device 21 or to endless conveyor 25 arranged adjacent the ballast distributing device and pivotal about vertical pivot 24 for swinging through an arc indicated by double-headed arrow **25*a* shown in FIG. 2. Drive 26 for endless conveyor 25 is preferably arranged to move the conveyor in either direction, as shown by double-headed arrow 25*b*. The bottom of ballast storage bin 23 has a ballast discharge opening of somewhat smaller width than the track gage, with an adjustable gate 27 driven by motor 28 for distributing selected amounts of cleaned ballast from the bin to the ballast bed therebelow, or to prevent cleaned ballast from leaving the storage bin, such a selectively operable ballast storage system being disclosed in U.S. Pat. No. 3,957,000, dated May 18, 1976. Selective operation of ballast distributing device 22 and swinging ballast conveyor 25 makes it possible to convey and distribute selected amounts of the cleaned ballast over the main track bed and/or laterally thereof, as shown by arrow 25*a***.

The conveyor could be swung around completely for delivering cleaned ballast to the other side of the main line if the bed widened at the side opposite to that shown in FIG. 2. The selective operation of ballast conveyor 25 and/or storage bin 23 makes it possible fully to control the supply of cleaned ballast to all points of the ballast bed as it gradually widens, ballast from the storage being available while dirty ballast is being excavated and screened for cleaning.

Ballast plow 29 is arranged adjacent and rearward of storage bin gate 27 to enable cleaned ballast discharged through the gate to be smoothed. The illustrated ballast plow is comprised of two plow halves 30, 31 enclosing an acute angle pointing towards gate 27 and is vertically adjustably mounted on machine frame 1 by hydraulic motors 32. Supplemental plow parts 33 are pivoted to the outer ends of plow halves 30, 31, hydraulic drives 34 being connected to the supplemental plow parts to move them into desired positions about the vertical pivots which hinge the supplemental plow parts to the plow halves. This assures rapid adjustment for leveling cleaned ballast over varying widths, making it possible to handle large amounts of cleaned ballast efficiently. Furthermore, the plowshares may be low enough for the plow to be used under an excavated track.

The waste coming from screen 18 is discharged through outlet 35 onto endless waste conveyor 36 which conveys the waste to a short conveyor 37 which is pivotal about a vertical axis to throw the waste off, either along the right of way or onto trucks which may be moved next to the right of way to transport the waste away.

All of the ballast excavation, cleaning and conveying may be conventional, for instance as described in the above-mentioned patents.

As shown in FIG. 1, excavation chain 9, storage device 21 and plow 29 may be controlled from central operating cabin 38 mounted on machine frame 1 while a further operating cabin 39 may be mounted on the frame rearwardly to operate the waste conveyor 37 and possibly also to control the advance of the machine.

The speed of the drives for conveyors 25 and 37 is preferably adjustable to regulate the arcuate throw-off path of the cleaned ballast and waste respectively conveyed by these conveyors whereby the exact location of the thrown-off material may be closely controlled.

In the illustrated position, ballast cleaning machine 2 is positioned on ballast bed section 40 corresponding to a track switch region from which the track has been removed. In this position, the machine operates as follows:

As shown on the left in FIG. 1, after the track rails and ties have been removed, an uneven ballast bed remains, wherein ballast is intermingled with waste, such as dirt and sand. As the machine advances in the direction of arrow 3 on tracked undercarriages 7, 7, excavation chain 9 is operated to remove the dirty ballast from the bed and convey it to screen 18 where it is suitably cleaned in a known manner, the cleaned ballast being discharged through port 19 and conveyed by endless conveyor 20. A hydraulic motor for pivoting ballast guiding and distributing device 22 is remote-controlled from cabin 38 to discharge selected amounts of the cleaned ballast from conveyor 20 either to storage bin 23 or to conveyor 25, or to both, in controlled amounts.

As is apparent from FIG. 2, ballast bed section 40 becomes gradually wider as the machine advances, which requires transverse chain guide 12 to be lengthened by the successive addition of removable chain guide members 14, the chain being similarly lengthened by the addition of suitable chain links, all as fully disclosed in U.S. Pat. Nos. 4,014,389 and 4,043,398.

Suitable distribution of the cleaned ballast over all desired regions of the ballast bed is effectuated by proper control of ballast guiding and distributing device 22 so that, as may be desired, cleaned ballast is available in storage bin 23 for depositing below the machine along the main line and/or on endless conveyor 25 for depositing in the widening region of ballast bed section 40 laterally of the main line where a branch line starts. Proper distribution may be accomplished by cyclically pivoting ballast guiding and distributing device 22 for alternatingly supplying cleaned ballast to conveyor 25 and storage bin 23. Furthermore, the direction of movement of conveyor 25 may be reversed so that the conveyor delivers cleaned ballast to the storage bin. In this manner, all the cleaned ballast will be conveyed to storage bin 23 and none laterally of the main line without pivoting device 22. Conveyor 25 has a length of about twice the width of the track so that it may be able to deposit cleaned ballast over the side branch laterally of either side of the main line.

The cleaned ballast deposited on the bed is smoothed or leveled by operation of plow 29 which is lowered to the desired grade, supplemental plow parts 33 being pivoted into suitable positions (see FIG. 2) to enable the entire deposited ballast to be leveled by the plow. If desired, the ballast bed grade may be controlled by a reference system. The controlled delivery of cleaned ballast to the bed in association with the specific plow arrangement rearwards of the cleaned ballast deposition on the bed makes it possible to obtain an accurately graded and leveled ballast bed for subsequent laying of the track thereon, this effect being further increased by rear tracked undercarriage 7 which runs on the leveled ballast bed and further levels and compacts it along two longitudinally extending ribbons of ballast on which the track rails rest subsequently.

As shown by arcuate double-headed arrow *37a*, waste conveyor 37 may be swung into different positions and its speed sufficiently increased to increase the centrifugal force with which the waste is thrown off the conveyor correspondingly whereby any deposit of waste on the widening ballast bed section is avoided, thus making certain that the removed waste does not soil the clean and leveled ballast bed.

The hydraulic drives are all connected to a common hydraulic fluid sump 41 for operation of the various drives from cabin 38 or 39. Drives 42 and 43 for undercarriages 4 and 7, respectively, are also operated from this common power source 41, and the machine may be advanced in either direction on these undercarriages, the wheels of undercarriages 5 being lowered into engagement with the track rails when undercarriages 4 advance the machine along a track. The central control makes it possible, even under varying and difficult operation conditions, to make all necessary individual adjustments to proceed with the ballast work without interruption, and hydraulic drives withstand the roughest working conditions and readily produce the required power under closely controllable conditions.

A mobile track working machine of the type hereinabove described may be readily and rapidly moved from one working site to another and almost any shape of ballast bed, including track switches and branches, may be cleaned with such a machine without difficulty, simply by proper adjustment of the ballast distributing and leveling mechanisms to adapt the machine quickly and precisely to the required conditions. Furthermore, the machine may be used universally on straight track, at track switches and branches or on ballast bed sections from which the track has been removed, for various types of ballast work. In addition, when the machine is used at a track switch or branch, the work can be continued without interruption as the machine advances into a widening ballast bed section, the adjustable ballast excavation and distribution making it possible to remove dirty ballast and evenly to deliver cleaned ballast over varying widths of ballast bed and to level the cleaned ballast over such varying widths to produce an accurately leveled ballast bed grade for laying of new track. Also, the transition of the machine advancing from a track section to a ballast bed section without track can proceed smoothly and without interruption simply by switching from the on-track to the off-track undercarriages. This avoids dead times and increases the efficiency of the machine, the continuous work further enhancing the uniformity of the resultant ballast bed.

By placing the operating cabin in the range of the plow and the ballast storage bin, and providing the bin with a transparent wall portion through which an operator from the cabin may at all times observe the amount of ballast in the bin, the entire arrangement is made compact and the control operations are even further facilitated.

The arrangement of two on-track undercarriages at the ends of the machine frame, in addition to the swivel trucks, provides a solid support for the heavy machine while working on track and, additionally, facilitates movement of the machine into and off the track when its operation is changed to off-track work. Arranging the ballast excavation and distributing mechanisms between the undercarriages holds the working range of the machine to a relatively short section.

While plowshares 30 and 31 have been illustrated as fixed, various types of plows could be used, including plows whose central plowshares are adjustable in relation to each other, i.e. which are pivotally connected and/or vertically movable independently of each other, to make it possible to obtain any desired ballast bed profile. Furthermore, the plow may be vibratory to impart additional compaction to the leveled ballast.

The various ballast conveyors also may take various forms, including all types of endless band or chain conveyors. The ballast storage bin may have more than one discharge port, each preferably having a width less than the track gage while the length of ballast distributing conveyor 25 preferably extends over two track widths. The storage bin as well as the plow may be lifted when the machine is moved from site to site.

Figure 3:
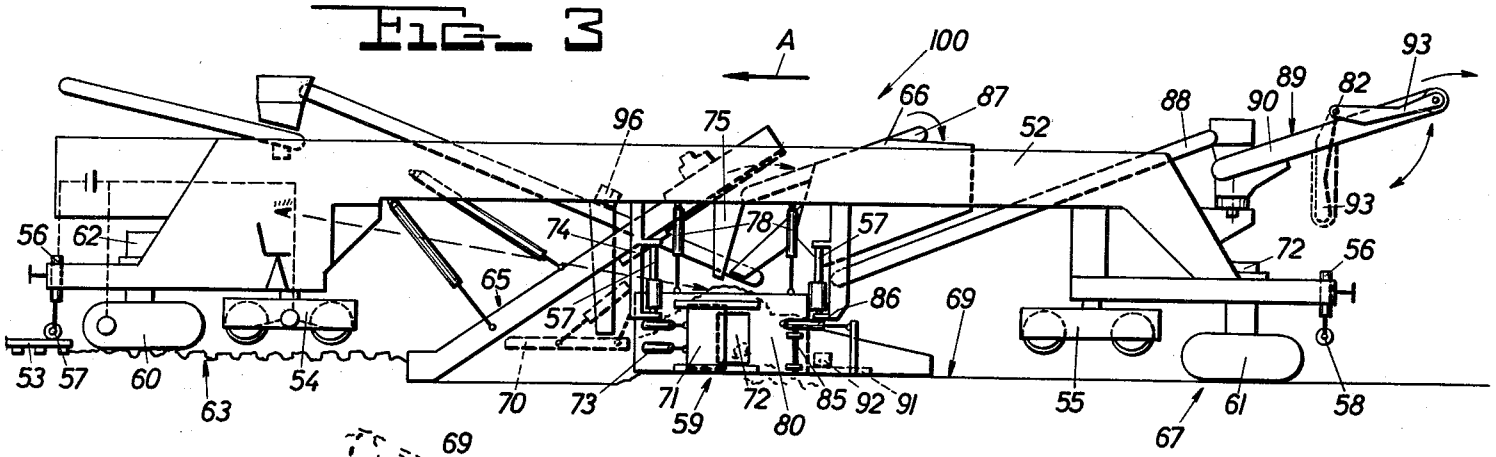
FIG. 3 is a view similar to that of FIG. 1, showing another embodiment of the machine.
Figure 4:
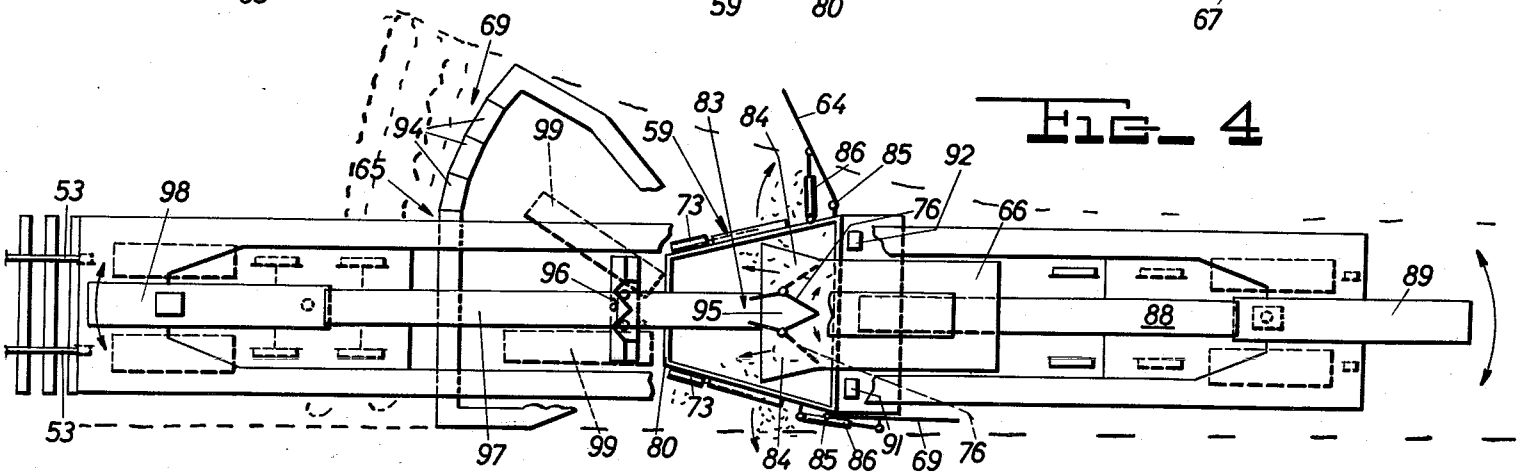
FIG. 4 is a top view of FIG. 3, similar to that of FIG. 2.

The self-propelled ballast cleaning machine 100 shown in FIGS. 3 and 4 comprises machine frame 52 movable in a working direction indicated by arrow A by on-track swivel trucks 54, 55, when the machine runs on track rails 53, in addition to auxiliary undercarriages 57 and 58 movable vertically as well as transversely of the track for selective engagement with the track rails, hydraulic drives 56 mounting the auxiliary single-axle undercarriages on machine frame 52 for vertical movement with respect thereto. Undercarriages 60 and 61 are track-laying bogies mounted between on-track undercarriages 54, and 55, 58, hydraulic motors 62 mounting the off-track undercarriages 60 and 61 on machine frame 52 to enable the machine to move on ballast bed 69, all of this structure being similar to that of the first-described embodiment and functioning likewise. Each pair of on-track undercarriages forms with its associated off-track undercarriage a triple undercarriage set 67 at respective ends of machine frame 52. At least one of the on-track undercarriages 54, 55 and associated off-track undercarriage 60, 61 of each undercarriage set 67 is connected to a drive so that the machine may be self-propelled either on track 53 or on ballast bed 69, i.e. on- or off-track.

In the same manner as in the first-described embodiment, ballast excavation chain 65 is mounted on the machine frame between the two sets of undercarriages. Also, as in that embodiment, the transversely extending chain guide is transversely extendible by insertion of removable guide members 94 so that the excavation chain may be operated at a track switch where the ballast bed widens. Vibratory ballast screen 66 is mounted on machine frame 52 for receiving removed ballast and waste excavated from the ballast bed. Ballast leveling plow 59 is vertically movably mounted on the machine frame along guide columns 57 by hydraulic drives 78 which support the plow on the machine frame for moving the plow vertically. Box-shaped plow 59 comprises two substantially vertically extending side walls 80 defining ballast discharge port 72 which can be selectively opened and closed by slide door 71 which is operated by hydraulic drives 73 remote-controlled from the cab of the machine. In this manner, selected and controlled amounts of ballast may be discharged from inside box-shaped plow 59 towards the flanks of the ballast bed. A lateral plowshare 64 is pivoted to the box-shaped plow 59 at pivot 85 for adjustment along the ballast bed flanks, hydraulic drives 86 being linked to the plowshares for adjusting their position, one of the plowshares being shown in extended position in FIG. 4 while the other plowshare is folded back to extend substantially parallel to the track. Any suitable position may be selected by operation of drives 86, these drives also being preferably remote-controlled from the cab.

In the particular ballast cleaning mechanism illustrated, the dirty ballast excavated by chain 65 is moved to vibratory screen 66 by endless ballast conveyor band 67 positioned intermediate the upper end of the excavation chain and the screen. The waste is removed from underneath the screen by elongated conveyor 88 which moves the waste to discharge conveyor 89. As best shown in FIG. 4, conveyor 89 may be pivoted about a vertical axis transversely of the track and is comprised of hinged parts 90 and 93, conveyor part 93 being pivotal about horizontal pivot 82 to be folded downwardly into a position shown in broken lines in FIG. 3. In this folded position, the discharge conveyor will fit within the profile of the entire machine and will require no special attention when the machine is moved from working site to working site, for example.

FIG. 2 illustrates ballast distributing arrangement 33 for the cleaned ballast coming from vibratory screen 66. This ballast distributing arrangement comprises two lateral chutes 84 leading from the screen directly into box-like plow 59 and intermediate chute 95 whose upper walls are constituted by pivotal baffle walls 76 which may be adjusted so that the screened ballast is directed exclusively or partially to center chute 95. The center chute discharges any cleaned ballast directed thereto on elongated endless ballast conveyor band 97 extending centrally of rails 53 along the track or right of way. The discharge end of ballast conveyor 97 leads to conveyor band 98 which is pivotal about a vertical axis for lateral movement with respect to the track so that the ballast may be discharged from fast-moving discharge conveyor 98 to desired lateral positions over the ballast bed. Alternatively, baffles 96 located intermediate the input and discharge ends of conveyor 97 may be operated to direct the cleaned ballast to respective chutes positioned laterally of the conveyor to deposit the cleaned ballast on two ballast distributing conveyors 99 mounted between box-like plow 59 and excavation chain 65, conveyors 99 also being pivotal about a vertical axis to sweep laterally over the ballast bed for suitable distribution of the cleaned ballast. Just as ballast distributing conveyor 98, conveyors 99 may also be operated at such speeds that ballast is thrown centrifugally into the flank regions of the bed laterally of the track or right of way so that, when the machine operates in a widened section, the cleaned ballast will be properly distributed along the right of way by plow 59 as well over extended lateral areas sideways of the right of way, where it will be leveled by adjustable plowshares 64.

Ballast distributing conveyors 99 will be operated particularly in on-track operation of ballast cleaning machine 100 since box-like plow 59 usually is not used during such operation, thus assuring proper distribution of cleaned ballast over the entire width of the ballast bed under all operating conditions.

It will be useful to mount leveling plate 91 on box-like plow 59 behind the plowshares to extend at least over the width of the plow and, if desired, that of adjustable plowshares 64 to improve the leveling of the cleaned ballast over the width of the treated bed, the smoothing operation being further improved and a certain compaction of the cleaned ballast being obtained by mounting vibrators 92 on the leveling plate whereby the plate becomes a vibratory ballast compactor. If the plow is vertically movable under the control of a reference, a leveled bed at a desired grade can be obtained. The height of the box-like plow may be such that the plow could be used under a lifted track section or it may be lifted when the machine operates on-track and only the ballast distributing conveyors are used for ballast distribution without leveling.

The ballast cleaning operation of machine 100 moving in the direction of arrow A proceeds in the following manner, off-track operation being illustrated:

Excavation chain 65 removes ballast from the illustrated switch position, after the track has been removed, chain guide members 94 having been inserted into the lateral chain guide of the excavation chain to enable the apparatus to work in the widened ballast bed section. The ballast is discharged from the upper end of the excavation chain either to conveyor 27, which takes it to screen 66 for cleaning, or through a discharge port in the bottom of the excavation chain guide which may be selectively opened and closed by a slide door operated by drive 74, ballast being discharged through the opened port into chute 75 which discharges the ballast directly into box-like plow 59. If the ballast is dirty and has to be cleaned on screen 66, the waste is taken away on conveyor 88 and thrown off by discharge conveyor 89 laterally of the ballast bed or onto suitable trucks or railroad cars.

Cleaned ballast discharged from screen 66 is distributed by mechanism 83 to box-like plow 59 when baffles 96 are in the position shown in full lines, the plow serving as a ballast storage reservoir. If the width of excavation corresponds to that of plow 59, only the lower edge of the plow serves to level the ballast and the box-like plow itself serves as the sole ballast distributor. Is the excavation width wider than plow 59, as shown in FIG. 4, at least one of the lateral plowshares 64 is suitably pivoted and adjacent ballast discharge port 72 in side wall 80 of plow 59 is opened so that ballast is distributed over the widened bed and the distributed ballast is leveled, too. Since either or both ballast discharge ports and their associated pivotal plowshares may be operated by remote control, ballast may be selectively distributed and leveled at either side of the right of way or track. If the excavation width is considerable, requiring large amounts of ballast to be distributed over the lateral portion of the ballast bed, ballast may also be distributed by elongated conveyor 97, baffles 96 being operated to distribute ballast to discharge conveyors 99 which can throw ballast into the lateral portions of the bed. If more ballast is delivered by the excavation chain or from the screen than is required to provide a clean leveled ballast bed, it is possible to deliver such excess ballast by elongated conveyor 97 and discharge conveyor 98 to either side of the bed for intermediate storage for use, for example, in a subsequent surfacing operation when additional ballast is placed into the cribs after the track has been re-laid.

As shown schematically at the left of FIG. 3, auxiliary on-track undercarriages 57 and 58 serve to move the machine from off-track to on-track operation without interruption of the ballast excavation so that ballast may be excavated by excavation chain 59 up to the point where track rails 53 begin and, after the excavation chain has been lifted and the machine advanced further, the ballast bed may be leveled by plow 19 up to the beginning of the track section. In this manner, such short track sections as track switches may be removed for complete renewal of the ballast bed between adjoining track sections, the cleaning machine resting on track-laying bogies in these short trackless sections during the renewal operation without the necessity of moving these track-laying bogies on-track and thus possibly damaging the track. If desired, auxiliary on-track undercarriages 57 and 58 may be provided with their own drives so as to propel machine 100 on the track.

If off-track track-laying bogie 61 is provided with vibrating device, this bogie will additionally serve to pre-compact the leveled cleaned ballast bed in a manner explained hereinabove in connection with the first-described embodiment.

The arrangement of the plow arrangement 59 and ballast distributing conveyors 99 makes it possible selectively to operate on- and off-track, the transverse adjustability of the excavation chain as well as the plow arrangement making it possible to use the machine in widening ballast bed or track sections, such as switches, crossings and track branches. Since the machine is self-propelled on- as well as off-track, no additional tractors or other moving means are required.

Obviously, a variety of adjustable excavation chains and/or plow arrangements usable in ballast bed sections of increasing width may be used, the box-like plow may have more than two ballast discharge ports in its side walls and the various illustrated hydraulic drives may be substituted by other drive means, such as threaded spindles, ratchet or cable drives, and the like.

What we claim is:

1. A self-propelled ballast cleaning machine useful for work in track switch and other widening track sections and comprising the combination of (a) a machine frame, (b) selectively operable on-track and off-track undercarriages supporting the machine frame at respective end regions thereof for selected on-track or off-track operation, (c) a drive for the undercarriages for propelling the machine frame on- or off-track, (d) a ballast material excavation chain mounted on the machine frame and adjustable in width for operation in widening track sections, the chain having a portion for excavating engagement with the ballast, (e) a screen arrangement mounted on the machine frame and arranged to receive ballast material excavated by the chain from the chain for cleaning the excavated ballast material, (f) a ballast storage means mounted on the frame immediately adjacent the ballast excavating chain portion, the ballast storage means having adjustable ballast discharge port means capable of discharging controlled amounts of ballast from the storage means, (g) means for moving the excavated ballast material to the ballast storage means, and (h) a ballast plow means vertically movably mounted on the machine frame and arranged to level the ballast discharged from the storage means, the plow means including (1) plowshare means adjustable for leveling ballast in widening track sections.

2. The self-propelled ballast cleaning machine of claim 1, further comprising conveyor band means for distributing the excavated ballast material, the ballast material moving means comprising a conveyor band.

3. The self-propelled ballast cleaning machine of claim 2, wherein the ballast storage means comprises a storage bin receiving the ballast material from the conveyor band and the discharge port means is a remote-controllable adjustable gate in the bin, the ballast plow means being a plow with two plowshares enclosing an acute angle, the two plowshares pointing towards the storage bin.

4. The self-propelled ballast cleaning machine of claim 3, wherein the conveyor band is mounted on a vertically extending pivot positioned on the machine frame substantially centrally between the sides thereof, whereby the conveyor band may be pivoted into selected positions enabling the ballast material to be delivered to either side for leveling by selected ones of the plowshares.

5. The self-propelled ballast cleaning machine of claim 4, wherein the conveyor band means comprises an elongated conveyor band receiving cleaned ballast from the screen arrangement and having an outlet end arranged for selectively delivering the cleaned ballast to the storage bin or to the first-named conveyor band.

6. The self-propelled ballast cleaning machine of claim 5, further comprising an adjustable ballast guiding and distributing device arranged between the outlet of the elongated conveyor band and the first-named conveyor band for selectively directing the cleaned ballast to the storage bin or to the conveyor band.

7. The self-propelled ballast cleaning machine of claim 4, wherein the adjustable plowshare means comprises two laterally extending plowshares pivotal about a vertical axis for selectively leveling outside ballast bed regions, the pivotal conveyor band having a length equal to at least two track widths for delivering cleaned ballast to widening track sections.

8. The self-propelled ballast cleaning machine of claim 3, wherein the storage bin is a funnel-shaped hopper and the adjustable gate comprises a discharge slot extending transversely of the track and having a width less than the track gage, and a remote-controlled slidable door over the slot.

9. The self-propelled ballast cleaning machine of claim 1, further comprising hydraulic drives for operating the adjustable ballast discharge port means, for vertically moving the ballast plow means and for adjusting the plowshare means, and a common hydraulic operating source for all drives, an operating cab being mounted on the machine frame for remote control of the drives.

10. The self-propelled ballast cleaning machine of claim 9, wherein the operating cab is arranged substantially above the plow means and facing the ballast discharge port means.

11. The self-propelled ballast cleaning machine of claim 10, wherein the side of the ballast storage means facing the operating cab is at least partially of transparent material to enable an operator in the cab continuously to observe the amount of stored ballast.

12. The self-propelled ballast cleaning machine of claim 1, wherein the ballast storage and plow means are mounted immediately adjacent each other between the undercarriages at the respective end regions.

13. The self-propelled ballast cleaning machine of claim 12, wherein two on-track undercarriages and an off-track undercarriage therebetween are arranged at each of the end regions, at least one of the on-track undercarriages being vertically movable.

14. The self-propelled ballast cleaning machine of claim 1, further comprising conveyor band means for distributing cleaned ballast from the screen arrangement in selected directions and for discharging waste from the screen arrangement in selected directions.

15. The self-propelled ballast cleaning machine of claim 1, wherein the on-track undercarriages at each of the end regions are a swivel truck and a vertically movable auxiliary undercarriage, and the off-track undercarriages are vertically movable track-laying bogies, each of the bogies being mounted between a respective swivel truck and auxiliary undercarriage to form a set of three undercarriages at each end region, the ballast material excavating chain is mounted between the sets and the ballast plow means is mounted adjacent the excavating chain portion, the plow means including a box-like portion constituting the ballast storage means and the plowshare means consisting of two lateral plowshares pivoted to the box-like portion at a rear end thereof for pivoting the plowshares about a vertical axis for selectively distributing and leveling ballast material laterally of the box-like portion.

16. The self-propelled ballast cleaning machine of claim 15, further comprising a pair of ballast material distributing conveyor bands extending in the direction of the machine frame and mounted adjacent the box-like plow portion, the conveyor bands being pivotal about vertical axes and arranged for distributing ballast material over selected lateral regions over at least about two widths of the track.

17. The self-propelled ballast cleaning machine of claim 15, wherein the box-like plow portion has two side walls defining the adjustable ballast discharge port means adjacent the pivot of the lateral plowshares.

18. The self-propelled ballast cleaning machine of claim 15, wherein the box-like plow portion comprises a ballast leveling plate mounted behind the pivots of the plowshares.

19. The self-propelled ballast cleaning machine of claim 18, further comprising means for vibrating the ballast leveling plate.

* * * * *